United States Patent [19]

Mallian

[11] 4,022,117

[45] May 10, 1977

[54] PRESSURE STABILIZING ASSEMBLY

[76] Inventor: Robert J. Mallian, 824 Swan, Springfield, Mo. 65807

[22] Filed: Mar. 12, 1975

[21] Appl. No.: 557,782

[52] U.S. Cl. ..... 98/42 R; 98/119; 49/141; 52/1; 137/360

[51] Int. Cl.[2] ..... F24F 7/00; F24F 13/00

[58] Field of Search ..... 98/32, 37, 42, 119, 98/114, 2.18, 95; 49/31, 70, 171, 141; 52/1, 198, 302, 303; 137/360; 220/88 R

[56] References Cited

UNITED STATES PATENTS

| | | | |
|---|---|---|---|
| 1,397,739 | 11/1921 | Moyer | 98/32 |
| 1,493,655 | 5/1924 | Vernon | 98/95 |
| 1,575,144 | 3/1926 | Bishop | 98/119 |
| 1,975,316 | 10/1934 | Ferris | 98/119 X |
| 2,223,709 | 12/1940 | Wickstrom et al. | 98/2.18 |
| 2,718,187 | 9/1955 | Frisby | 98/37 |
| 2,814,977 | 12/1957 | Noll | 98/37 |
| 2,849,941 | 9/1958 | Negoro | 98/2.18 X |
| 3,278,114 | 10/1966 | Gibbs | 98/116 X |
| 3,453,777 | 7/1969 | Reilly | 49/141 |
| 3,521,546 | 7/1970 | Day | 92/32 |

FOREIGN PATENTS OR APPLICATIONS

| | | | |
|---|---|---|---|
| 470,675 | 5/1926 | Germany | 98/37 |

*Primary Examiner*—Ronald C. Capossela
*Attorney, Agent, or Firm*—Cushman, Darby & Cushman

[57] ABSTRACT

A pressure stabilizing assembly for installation in an enclosure wall to prevent damage to the enclosure as a result of rapidly decreasing atmospheric pressure. The assembly includes a chamber with side, top, and bottom walls, a solid end wall, and an open face. The bottom wall has an opening therein, and a pivoted plate is provided for normally closing the opening, and allowing the passage of air therethrough only from the interior of the chamber to the exterior thereof, and then only under conditions of rapidly decreasing atmospheric pressure. A screen and bezel may be mounted on the portion of the chamber interiorly of the enclosure.

5 Claims, 2 Drawing Figures

PRESSURE STABILIZING ASSEMBLY

BACKGROUND AND SUMMARY OF THE INVENTION

The invention relates to a pressure stabilizer assembly for installation in homes, trailers, and the like to minimize the chances of damage thereto as a result of low pressure atmospheric conditions existing during tornados. During a tornado, the atmospheric pressure drops significantly. If there is no free flow of air provided between the interior of a home, trailer, or the like and the atmosphere, the resultant pressure differential between the interior and exterior of the enclosure results in the enclosure "exploding".

In the past there have been a number of proposals for the equalization of air pressure between the interior and the exterior of a dwelling. Some of these proposals, such as shown in U.S. Pat. Nos. 1,493,655 and 1,575,144 take the form of ventilation providing means, allowing the equalization of air pressure under all conditions. While these devices may result in effective tornado protection if installed in sufficient quantities, they provide for no insulation of the interior of the dwelling from the exterior thereof, and provide for the entry of too much air to allow for effective heating or air-conditioning of the dwelling. Other proposals, such as shown in U.S. Pat. Nos. 3,453,777 and 3,521,546 have contemplated specially designed structures for the pressure-equalization of a dwelling during tornados. Such structures can be unpleasing aesthetically, however, difficult to install, and not entirely effective in preventing the entrance of atmospheric air under certain conditions.

According to the present invention, a pressure stabilizing assembly to protect a dwelling or other enclosure during low-pressure atmospheric conditions is provided that has the following advantages: It is easy to install, and is readily adaptable for installation in all types of enclosures, such as brick and frame homes, and trailers. It is relatively inexpensive to manufacture. It provides no aesthetically unpleasing appearance when viewed either from the interior or the exterior of the enclosure. It provides a relatively dead air space for good thermal insulation, while still operating properly during adverse pressure conditions. It presents the minimum opportunity for the entrance of wind from the exterior of the enclosure, and the minimum opportunity for the entrance of rain, snow, etc.

According to the present invention a chamber means is provided for installation into a wall of an enclosure, preferably adjacent an eave thereof. The chamber means includes two side walls, a top wall, a bottom wall having an opening therein, a solid exteriorly arranged end wall, and a permeable inner end wall allowing the passage of air from the interior of the enclosure into the chamber. Portions of the side, top, and bottom walls are mounted within the enclosure wall, and extend outwardly therefrom and are partially covered by an eave. The opening in the bottom wall is covered by a pivotal plate which is biased so that it normally closes said opening, but is movable to an open position to allow the passage of air from the interior of the enclosure to the exterior thereof under low pressure atmospheric conditions. Since the plate is located on the bottom portion of the chamber means, and since the whole chamber means is partially obscured by an eave, there is no aesthetically displeasing structure. Also, no wind or rain or the like is likely to impinge directly on the plate and seep through the opening thereof because it is arranged on the bottom of the chamber, and if any moisture does enter, it will tend to fall back downwardly through the opening.

It is the primary object of the present invention to provide an improved pressure stabilizing assembly for an enclosure. This and other objects of the invention will become clear from a detailed inspection of the invention, and from the appended claims.

DETAILED DESCRIPTION OF THE INVENTION

Figure 1:
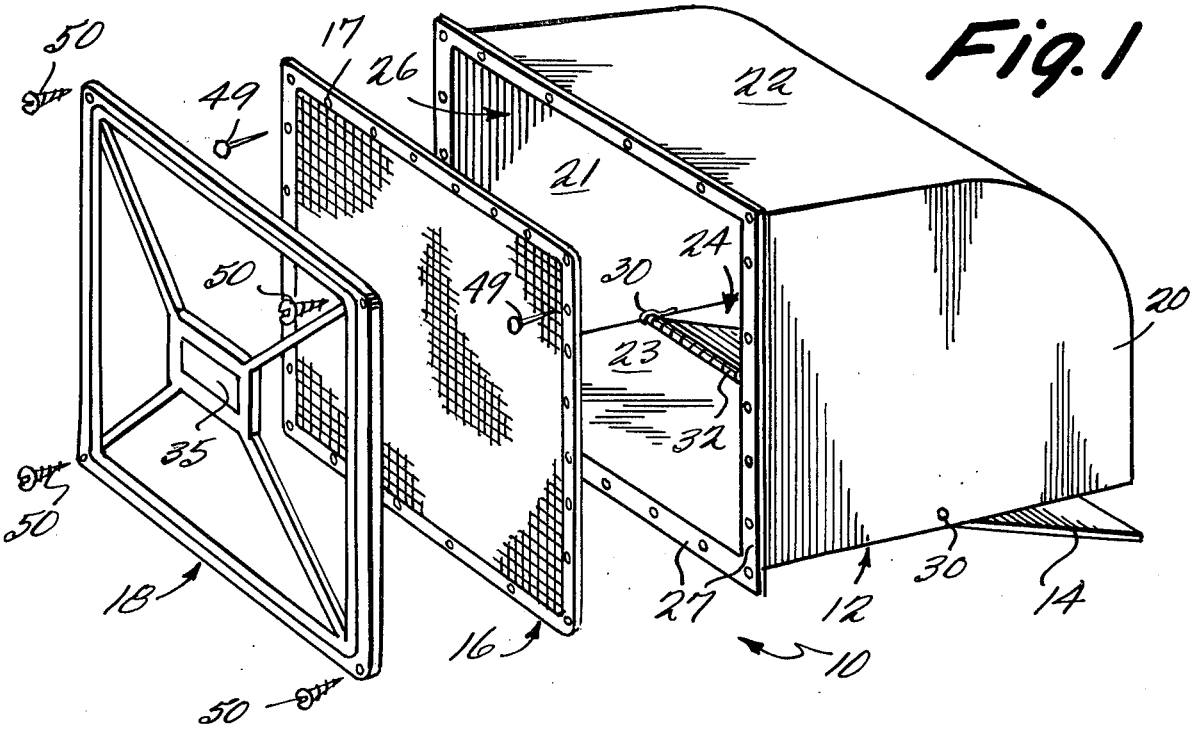
FIG. 1 is an exploded perspective view of an exemplary pressure stabilizing assembly according to the present invention.

An exemplary assembly for stabilizing the pressure in a dwelling or other enclosure under low pressure atmospheric conditions is shown generally at 10 in the drawings. The assembly 10 generally comprises a chamber means 12, having a pivoted plate 14 associated therewith, a front screen 16, and a front bezel or face plate 18. The chamber means 12 comprises two side walls, 20, 21, a top wall 22, a bottom wall 23 having an opening 24 therein, a first end wall 25 adapted to be disposed exteriorly of an enclosure in which the assembly is to be installed, and an open front end face 26 having a flange border 27 thereof. The open front end 26 is adapted to be disposed interiorly of an enclosure, and to receive a screen 16 and front bezel 18 or the like thereon. The opening 24 in the bottom wall 23 is closed under normal conditions by the pivoted plate 14. The plate 14 is mounted as by pivots 30 to the side walls 20, 21, and is biased into a sealing relationship with portion 23' of bottom wall 23 whereby high-pressure air outside the enclosure will not be admitted to the chamber. Suitable biasing means for biasing the pivoted plate 14 into engagement with wall portion 23' may include a torsion spring(s) 32 or the like.

Mounted to the front face 26 of the chamber means 12 there preferably is a screen 16. The screen 16 prevents the entry of insects or the like from the exterior of the enclosure in which the assembly 10 is mounted into the interior thereof, and also provides a background for the front bezel 18. The front bezel 18 preferably comprises a decorative member having a frame 34 for mounting thereof, and an interior design portion 35. The bezel 18 may be covered by a solid member when danger of tornados does not exist.

The assembly 10 according to the present invention is easy to install in a dwelling or the like, and is readily adaptable for all types of dwellings. Installation of an assembly 10 in a frame house is shown diagrammatically in FIG. 2. The bottom wall 23, substantially up to opening 24 therein, and top and side wall portions of the chamber 12 are received within an opening A cut in the wall 45 of a home, between the vertical studs 40 thereof. The opening A is preferably located adjacent an eave 42 or the like, and an opening B is formed in eave 42 for receipt of the front portion of the chamber 12. It will thus be seen that when so mounted, the assembly 10 does not provide an aesthetically unpleasant appearance when viewed from either the outside or inside, while still providing for pressure equalization when the atmospheric pressure is lower than the dwelling pressure.

Figure 2:
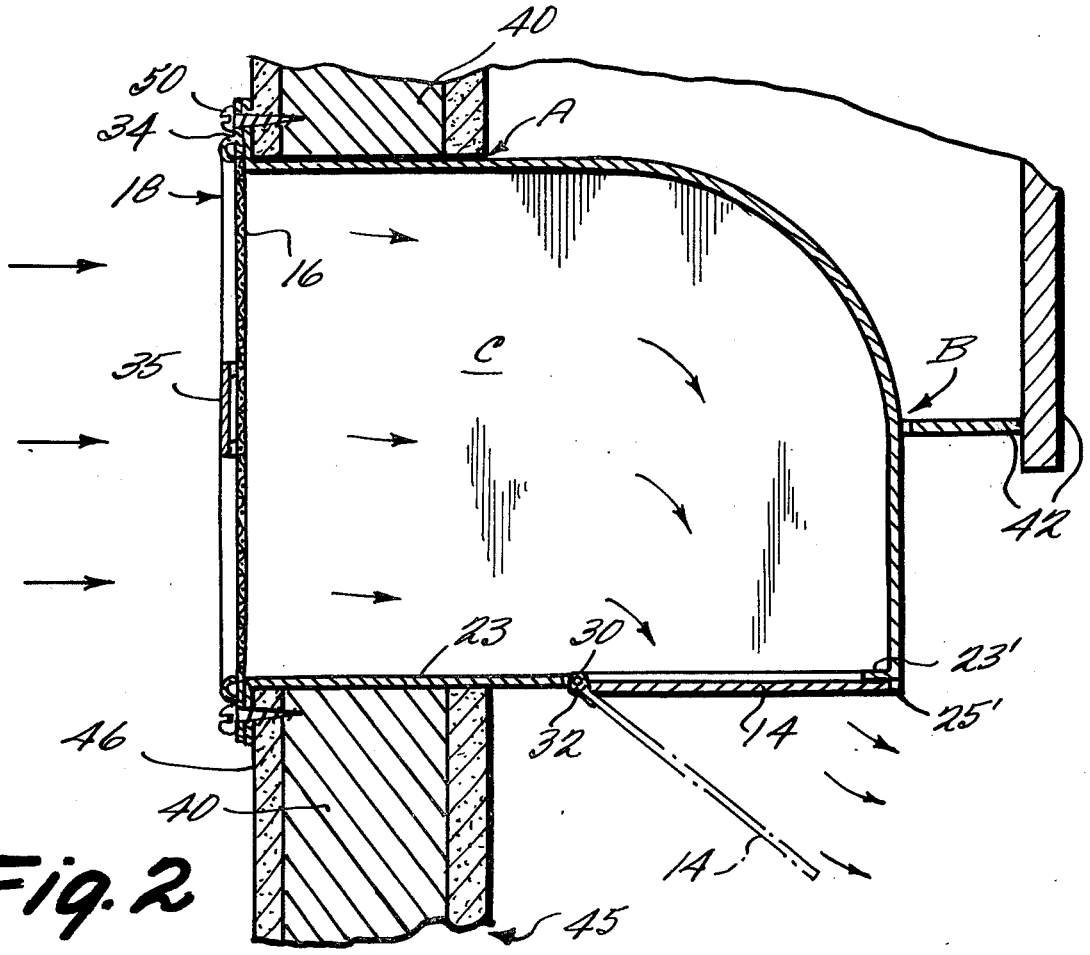
FIG. 2 is a side cross-sectional view of the assembly of FIG. 1 shown installed in a frame house.

As shown in FIG. 2, it is apparent that while properly performing its intended function, the assembly 10 is adapted to allow the entrance of a minimum of air from the exterior of the dwelling or the like in which it is mounted. Since the plate 14 is mounted in the bottom wall 23 of the chamber 12, wind, rain, and the like is not likely to impinge directly thereon, therefore the amount of wind, rain or the like from the exterior that enters the opening 24 will be minimal. Also, it is preferred that the exteriorly located end wall 25 be arranged so that a portion 25' thereof overlaps the plate 14 when it is in its closed position, whereby preclusion of the elements from the interior of the chamber 12 is further facilitated. This may be facilitated by raising the portion 23' of the bottom wall 23 that defines the opening 24 therein, and therefore portions of the side walls 20 and 21 will also overlap the plate 14 to further preclude the entrance of rain or the like into the interior of the chamber C. Also, the relatively large size of the chamber 12 necessary to provide for proper mounting results in a relatively dead air space C within chamber 12 being provided between the exterior and the interior of the dwelling, which provides for better thermal insulation of the enclosure than do most prior art devices.

Installation of the assembly 10 according to the present invention is simple and easy. Especially for a frame house, first a hole or opening A of the proper dimensions is cut into a side wall 45 of a dwelling or the like between vertical studs 40. An opening B of suitable dimension is also cut in eave 42. Then chamber 12 is installed within the openings A, B, portions of walls 20, 21, 22 and 23 being received within the opening A and between the studs 40, and the flange border 27 of the chamber 12 is disposed flush against the interior wall 46 of the dwelling. Then the frame or border of the screen 16 is placed flush against the border 27 of the chamber 12, and nails 49 or the like are passed through both the screen border 17 and the chamber border 27 to affix the chamber and screen 16 to the vertical studs 40 and other wall structures. Then the front bezel 18 may be affixed to the rest of the assembly 10 by screws 50 or the like passed through frame 34 into wall 46 of the dwelling. In this way the assembly 10 is easily and quickly installed within an enclosure. Only inner adaptions need be made for installation in such houses and trailers.

The chamber 12 may be formed in one piece, or be of two or more piece construction; it can be formed from steel or sheet metal, or may be of molded plastic. Other fastening means could be used besides those shown.

In use, when an assembly 10 is installed within an enclosure, should the atmospheric pressure drop rapidly, as results from the closeness of a tornado to the enclosure, air from the relatively high pressure interior of the enclosure will flow through screen 16 and the interior C of chamber 12, and force plate 14 to pivot downwardly against the bias of spring(s) 32. Depending upon the force of the air, the plate 14 will be moved to any of a number of downwardly extending positions, such as those shown in dotted line in FIG. 2. The plate 14 will return to its normal position upon the cessation of the higher pressure conditions within the dwelling. It is preferred that a number of assemblies 10 be mounted within a dwelling in order to provide proper minimization of damage, preferably one assembly per 3500 cubic feet of air space within a dwelling. It is obvious that the lengths of the side, top, and bottom walls may be varied depending upon the structure in which the assembly is to be installed, as may the other dimensions.

While the invention has been herein shown and described in what is presently conceived to be the most practical and preferred embodiment, it will be obvious to one of ordinary skill in the art that many modifications may be made thereof within the scope of the invention, which scope is not to be limited except by the appended claims.

What is claimed is:

1. A combination of an enclosure and a pressure stabilizing assembly for use in the enclosure for generally equalizing the pressure within the enclosure and the atmosphere during rapidly developing low pressure atmospheric conditions, said enclosure having an enclosure wall for the mounting of the assembly and an eave, and said assembly comprising a. a chamber defining means, said means including two side wall members, a top wall member, a bottom wall member, and first and second end wall members, portions of said side wall members, said top wall member, and said bottom wall member being for receipt within the wall of the enclosure, and portions thereof extending outwardly from the enclosure wall to the exterior of the enclosure and within an opening in said eave, b. said first end wall member being solid and rigid and for location exteriorly of said enclosure, c. said second end wall member for terminating said chamber means within the enclosure, and said second end wall member comprising means for allowing the flow of air between the chamber and the interior of the enclosure, said second end wall member including a continuous grid wire screen, d. means defining an opening in a portion of the bottom wall member for location exteriorly of the enclosure, and exteriorly of said eave, e. a plate for normally covering said opening in said bottom wall member, f. means for pivotally mounting said plate for movement between a first position wherein said plate closes off said bottom wall member opening, and a second position wherein said plate allows the passage of air from the interior of the chamber to the exterior of the enclosure, g. means for biasing said plate into said first position, said plate being movable from said first position only against the bias of said biasing means.

2. An assembly as recited in claim 1 wherein said bottom wall member includes a raised portion thereof, said raised portion defining said opening therein, and wherein said side wall members and said first end wall member extend downwardly past said raised portion of said bottom wall member, and past a surface of engagement of said plate with said bottom wall member raised portion, whereby the opportunity of wind, rain, or the like entering from the exterior of the chamber to the interior thereof is minimized.

3. An assembly as recited in claim 1 wherein said second end wall member further comprises a bezel, said screen being disposed between said bezel and the rest of the chamber defining means.

4. An assembly as recited in claim 3 wherein said screen and said bezel are formed separately from the rest of said chamber defining means, and wherein assembly thereof during installation in the enclosure wall is necessary, and wherein the rest of the chamber defining means besides said bezel and said screen includes a flange border for disposition against the interior of the enclosure wall in which said assembly is mounted, said flange border for location and mounting of said assembly.

5. An assembly as recited in claim 1 wherein said plate biasing means comprises torsion spring means.

* * * * *